US005897742A

United States Patent [19]

Semmler

[11] Patent Number: 5,897,742

[45] Date of Patent: Apr. 27, 1999

[54] HAND-HELD IMPLEMENTS FOR TRANSFERRING A FILM FROM A BACKING STRIP ONTO A SUBSTRATE

[75] Inventor: Georg Semmler, Wiesbaden, Germany

[73] Assignee: Tipp-Ex GmbH & Co. KG, Liederbach, Germany

[21] Appl. No.: 08/920,385

[22] Filed: Aug. 29, 1997

[30] Foreign Application Priority Data

Sep. 2, 1996 [DE] Germany ..... 196 35 587

[51] Int. Cl.[6] ..... B44C 7/02; B65D 85/67; B32B 35/00

[52] U.S. Cl. ..... 156/577; 156/579; 156/540; 206/393; 206/411; 242/160.2

[58] Field of Search ..... 156/577; 206/411, 206/393; 118/76; 242/160.2, 170, 615.4, 588.6, 588.3, 557, 558

[56] References Cited

U.S. PATENT DOCUMENTS

| | | | |
|---|---|---|---|
| 3,743,086 | 7/1973 | Aldrich | 206/52 R |
| 3,917,090 | 11/1975 | Montagnino | 214/146.5 |
| 4,271,962 | 6/1981 | Stepanski | 206/411 |
| 4,849,064 | 7/1989 | Manusch et al. | 156/577 |
| 5,281,298 | 1/1994 | Poisson et al. | 156/579 |
| 5,480,510 | 1/1996 | Manusch et al. | 156/577 |
| 5,507,386 | 4/1996 | Foote | 206/394 |
| 5,770,007 | 6/1998 | Czech et al. | 156/540 |
| 5,792,263 | 8/1998 | Koyama et al. | 118/257 |

*Primary Examiner*—David A. Simmons
*Assistant Examiner*—Sue Purvis
*Attorney, Agent, or Firm*—Kilgannon & Steidl

[57] ABSTRACT

The invention relates to a hand-held implement for transferring a film (25) from a backing strip (7) wound on a supply real (5) onto a substrate, the said implement having a housing (2), a pressure-exerting part (16) projecting therefrom, and two bearing and/or carrier devices for the supply reel (5) and a take-up real (6) for the backing strip (7) guided around the pressure-exerting part (16), the housing being able to be opened for the purposes of replacing the reels (5,6). In order to be able to load such a hand-held implement simply and quickly without the costs and material expenditure involved in a replaceable cassette, a loading aid (30) provided for loading the opened housing (2) with the reels (5,6) is proposed in a mutual arrangement of these reels (5,6) that is substantially identical to that of the bearing and/or carrier devices, the loading aid having at least one guide element (34) associated with the guide surface (16*b*, 18) of the pressure-exerting part (16), which element is designed to ensure that the backing strip (7) extending between the two reels (5,6) rests against the latter in such a way that when the loading aid (30) is in place it at least partially surrounds or envelopes the pressure-exerting part (16).

27 Claims, 4 Drawing Sheets

Fig.11
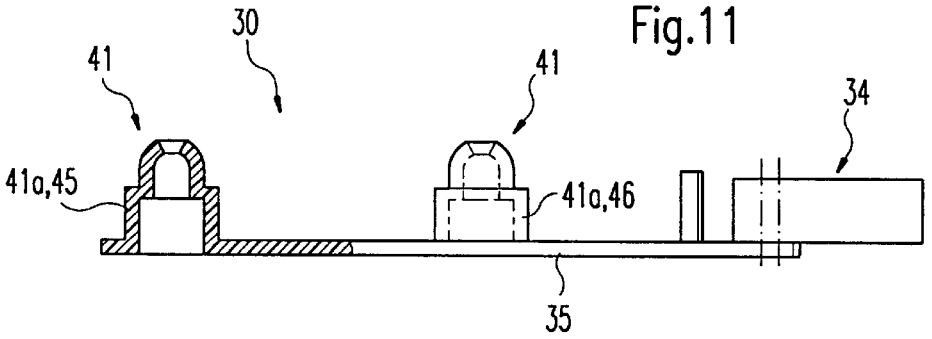
Fig. 10
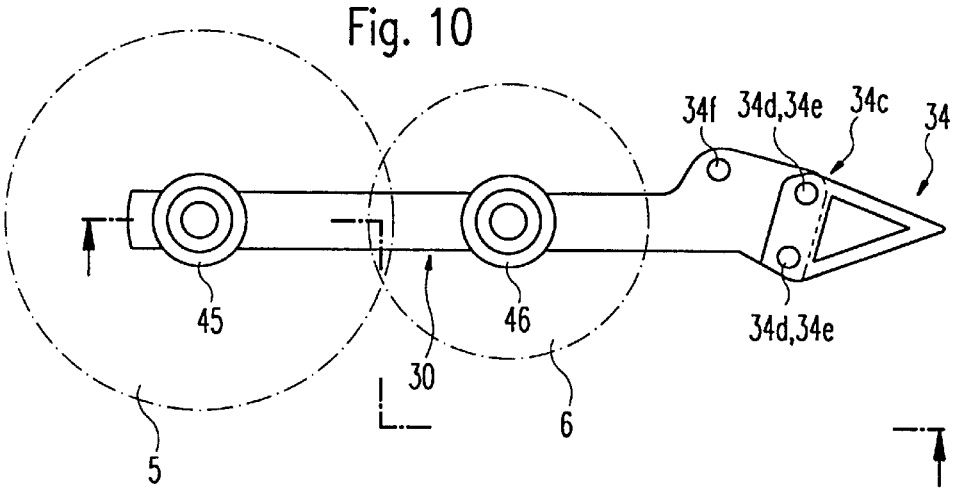
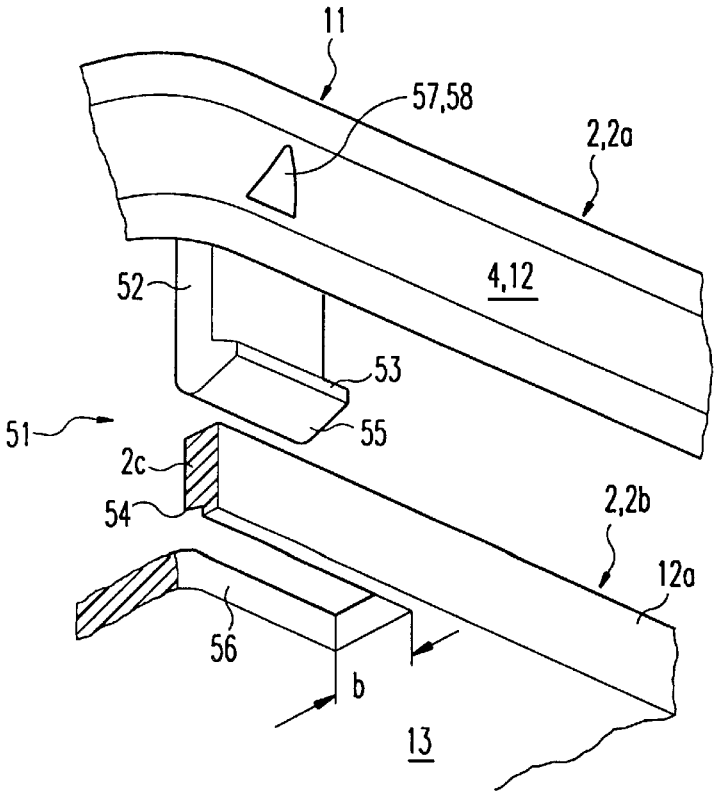
Fig. 12

HAND-HELD IMPLEMENTS FOR TRANSFERRING A FILM FROM A BACKING STRIP ONTO A SUBSTRATE

BACKGROUND OF THE INVENTION

The present invention relates to a hand-held implement for transferring a film of e.g. an adhesive, coating or colored material from a supporting strip wound on a supply reel onto a substrate, the said implement having a housing, a pressure-exerting part protecting therefrom and two bearing and/or carrier devices arranged in the interior of the housing for the supply reel and a take-up reel for the supporting strip unwound from the supply reel and guided round the pressure-exerting part, the housing being able to be opened for the purposes of replacing the supply reel and the take-up reel.

With such a hand-held implement the length of the film and thus also the capacity of the hand-held implement is predetermined by the length of the supporting or backing strip, which forms a supply arranged in the hand-held implement. This supply accordingly has to be replaced after the film has been used up. One possibility of doing this, namely replacing exclusively the supply reel and the take-up reel together with the backing strip is impracticable since it is difficult to handle the reels without winding the backing strip and, in particular, to incorporate them in the housing. Although it is relatively simple to remove the spent backing strip together with the associated supply and take-up reels, since these parts can simply be thrown away, it is nevertheless difficult to incorporate these replacement parts and further incorporation errors may arise that could put an end to the proper correct functioning of the hand-held implements One possible way of solving this problem is to arrange the supply reel, the take-up reel and the backing strip in a replacement cassette that can simply be replaced after the supply has been used up. Such a hand-held implement is described for example in DE 36 44 946 C2. With this known design the replacement cassette includes not only the supply reel and the take-up reel together with the backing strip, but also an application device for pressing the backing strip onto the substrate, which device projects forwardly from the housing of the hand-held implement and around which the backing strip is drawn when the film is transferred to the substrate.

This known design is material-consuming since each time the materials are replaced not only the supply reel and the take-up reel together with the backing strip, but also the replacement cassette, including the application device together with the associated retaining parts, are replaced and consequently lost.

The object of the invention is to provide a hand-held implement of the type described at the beginning that enables the supply reel and take-up reel together with the backing strip to be replaced with less expense and effort.

SUMMARY OF THE INVENTION

With the design according to the invention a loading aid is provided to accommodate the reels and the backing strip in a mutual arrangement that is essentially the same as that of the reels and the backing strip in the housing. In this way it is possible, from a position of the loading aid in which the aforementioned arrangements of the reels and backing strip coincide, to displace the said reels and the backing strip from the loading aid to the associated bearing and positioning parts of the housing. The loading aid thus acts as a means by which the reels and the backing strip are on the one hand held in a position coinciding with the arrangement in the housing, and on the other hand it is possible, from a transfer position in which the positions coincide, to displace the reels and the backing strip into the functional position in or on the housing of the hand-held implements The design according to the invention provides the following advantages. On the one hand it significantly reduces the material expenditure since the loading aid can be formed as a temporary device in a simple and light form of construction, which merely serves to hold the reels and the backing strip in the specific arrangement without having to satisfy further stability and functional requirements, as is the case with a replacement cassette. At the same time the loading aid can form a packaging means for the reels and the backing stripe which means that a separate special packaging means can be dispensed with. The loading aid together with the reels and the backing strip may be arranged in various ways in the transfer starting position, in which the said reels and backing strip can be inserted into the housing. On the one hand it is possible to align the loading aid visually in the transfer starting position. In this connection special features such as marks or edges on the loading aid can serve to recognize the correct transfer starting position by comparison with associated marks or edges on the housing. It is also possible and in fact advantageous to arrange a positioning device, for example a plug-in socket, between the loading aid and the housing so that the loading aid simply needs to be inserted into the positioning device, where it will necessarily be in the correct transfer starting positions In its functional position in the hand-held implement the backing strip runs around the application device in the form of an arcuate loop that is also preset on the loading aid, so that the loop can be slipped onto the application device. To this end the loading aid has a guide element that secures the position of the loop and ensures that the loop is displaced onto the application device when the spools are transferred to the housing. In this connection it is also possible within the scope of the invention for the guide element of the loading aid to support the loop on the outside or, preferably, on the inside. Such a backing measure is sufficient to stabilize the loop for the transfer procedure so that the said loop can be displaced without any difficulty onto the application device during the transfer. The guide element of the loading aid preferably has a shape adapted to the application device so that the wedge shape of the loop can be preset in such a way that the said loop can be displaced without any difficulty onto the application device during the transfer. In this connection the guide element of the loading aid can be at a somewhat greater distance from the reels than the application device, so that in the transfer state the loop surrounds the application device with a certain degree of play. This does not cause any problems since the play can be eliminated either by a slight manual actuation of the take-up reel or is automatically eliminated when the hand-held implement is used, since the take-up reel is driven with a greater winding speed than the withdrawal speed of the backing strip.

After the transfer of the reels and the backing strip the loading aid can be disposed of as a low material content structural part, or alternatively it is possible to reuse it as a carrier and optionally also as a bearing and transporting means.

BRIEF DESCRIPTION OF THE DRAWINGS

The invention and further advantages achievable therewith will be described in more detail hereinafter with the aid of preferred embodiments and figures, in which:

FIG. 10 is a plan view of further modified loading aid, FIG. 11 is a side view of the loading aid according to FIG. 10, and FIG. 12 shows a locking device for the housing of the hand-held implement.

DETAILED DESCRIPTION OF THE INVENTION

Figure 1:
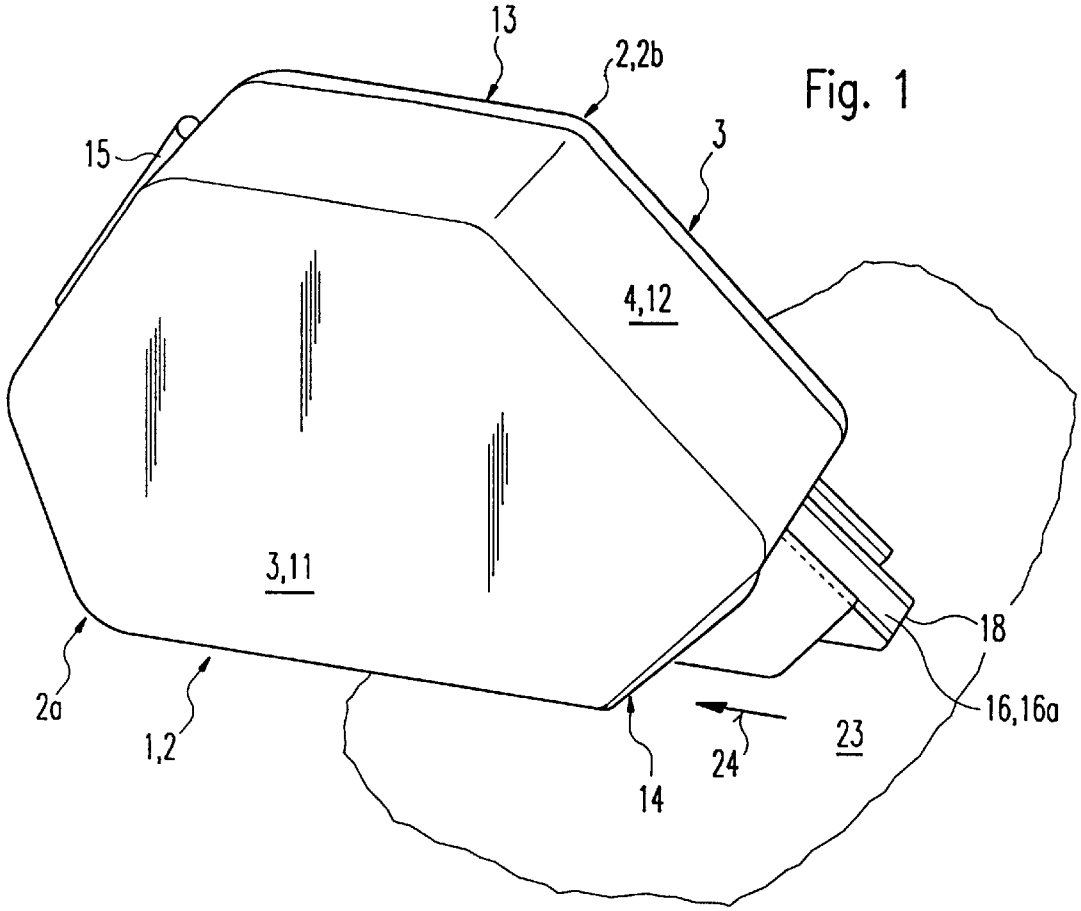
FIG. 1 is a perspective view of the hand-held implement according to the invention.
Figure 2:
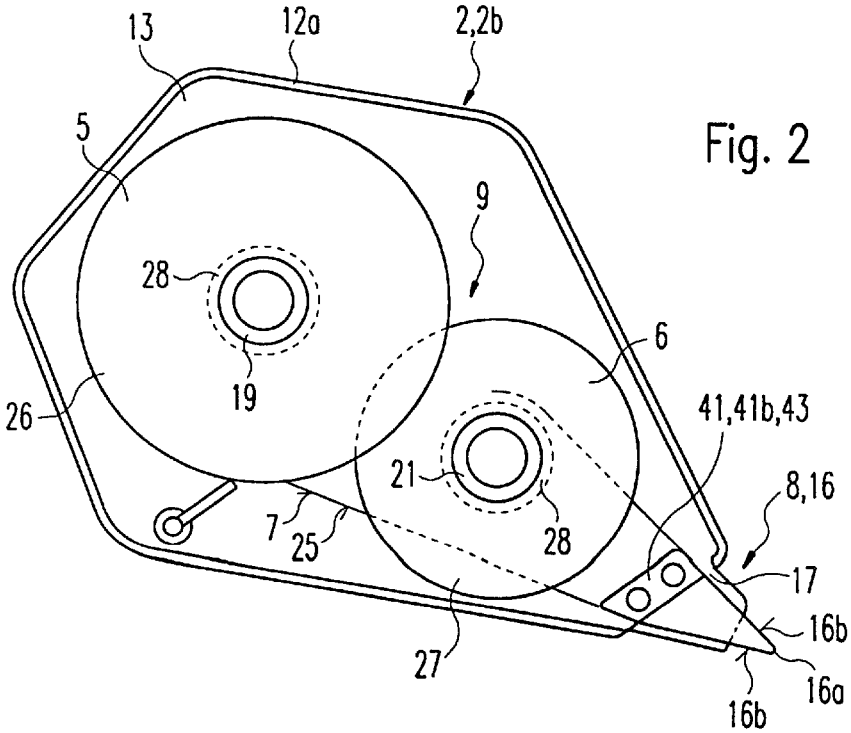
FIG. 2 is a plan view of a housing part of the hand-held implement.

The hand-held implement has a box-shaped housing 2 of such a size that it can be held easily and comfortably in the hand. The housing 2 is of flat construction with oppositely facing, parallel or approximately parallel broad sides 3 and narrow sides 4. In the functional position the housing may be arranged flat or, in the case of the present embodiment, with the edge uppermost. A supply reel 5, a take-up reel 6 together with a backing strip 7 forming a supply, an application device 81, and a drive device 9 active between the supply reel 5 and the take-up reel 6 are arranged in the cavity of the housing 2.

The housing 2 is designed in two parts, with a pot-shaped housing part, hereinafter identified as the under part 2*a*, containing a broad side wall 11 and the narrow circumferential wall 12, and a housing upper part containing the other broad side wall 13 and fulfilling the function of a cover 2*b*, which parts can be connected to one another by a closure device, preferably in the form of a locking device 14. The housing parts can be joined to one another by means of a hinge 15, which is preferably arranged opposite the application device 8 on the associated end of the housing 2, which is preferably oblong in this direction.

The application device 8 is formed by a wedge-shaped pressure-exerting or application part 16, which is secured to one of the two housing parts in such a way that its wedge section 16*a* projects outwardly through an opening 17 in the circumferential wall 12. The wedge vertex is formed by a rectilinear tip 18 that extends transverse to the broad sides in the case of the present embodiment of the housing, and in which terminate the two back surfaces 16*b* of the wedge shape. The application part 16 can be formed in one part on one of the housing parts or can be formed as an additional structural part that can be joined by means of a plug-in socket in a positive-locking manner to one or both housing parts.

In order to mount the reels 5, 6, bearings are provided in the form of preferably hollow sleeve-shaped bearing shafts 19, 21, which are secured preferably in one piece on the inside on one of the two broad sidewalls of the housing. In the present embodiment the bearing shafts 19, 21 are arranged on the cover 2*b*, which may have a small transverse edge 12*a* for positive locking engagement with the circumferential wall 12. The application part 16 too is mounted on the inside of the cover 2*b*. In the open or closed position of the housing 2 the reels 5, 6 and the application part 16 are consequently freely arranged, in the case of a cover 2*b* lying on a bass with a broad side, on the inside of the said cover and are visible from above In the functional position the housing 2 is in a position such that the tip or apex 18 is situated on one side of the housing and the housing projects slightly downwards, with the result that it can be pressed onto a substrate 23, for example a sheet of paper lying on a support.

The backing strip 7 carries on its outside (according to FIG. 1, underside) a layer of an adhesive, coating or colored material. The strip is taken up on the supply reel 5 and runs in the working position of the hand-held implement 1 from the lower side thereof from below around the application part 16 and its tip 18 to the take-up reel 6. If the hand-held implement 1 in its functional position is displaced rearwardly in the direction of the arrow 24, then on account of the existing adhesion the material layer 25 together with the pressure-exerting part 16 is pressed onto the substrate 23, adhering to the latter and being released from the backing strip 7. The backing strip 7 is unwound from the supply reel 5 and wound by the drive device 9 onto the take-up reel 6. The transmission ratio of the drive device 9 is chosen to be sufficiently large so that the winding rate of the take-up reel 6 on its take-up circumference is equal to or larger than the unwinding rate on the unwinding circumference of the supply reel 5. This results in a so-called "advance" of the take-up reel 6, which ensures a certain degree of tension in the backing strip section 7*a* extending between the supply reel 5 and the take-up reel 6. In this connection the drive device 9 is designed so as to ensure a constant "slippage," i.e., it can be overwound, with the result that the tension in the backing strip 7 does not exceed a predetermined value.

The drive device 9 can be formed by a drive belt or by a direct frictional or toothed engagement on the reel walls 26, 27 the respective drive engagement being able to be "overridden" in order to avoid a damaging tension in the backing strip 7. For the sake of simplicity the drive device 9 is illustrated simply by means of an arrow. The reels 5, 6 consist in each case of a hollow cylindrical reel arrangement 28 from whose ends the two associated reel walls 26 and 27 extend radially outwardly and form the associated unwinding and take-up space for the backing strip 7.

When the film supply is used up, the reels 5, 6 together with the backing strip 7 can be removed in a simple manner from the aforedescribed mounting and positioning arrangements In order to load the opened housing 2 a loading aid 30 is provided on which a supply reel 5 and a take-up reel 6 together with an unused backing strip 7 are mounted respectively by means of a positioning device 31, 32, 33 in each case in a position corresponding to the position in the housing 2. The positioning device is 31, 32 for the reels 5,6 are formed in each case by a centering device that ensures the positioning. The positioning device 33 for the loop-shaped backing strip 7*a* is formed by a positioning element 34 that delimits the tip of the loop of the backing strip section 7*a* internally or externally in a shape that corresponds to or is dimensioned larger than the loop shape in the working position. The arrangement is designed so that the reels 5,6 and the backing strip 7*a* can be removed from one side of the loading aid 30. The positioning devices 31, 32, 33 are connected by a rod-shaped or plate-shaped carrier element 35 to form a structural unit. In the present embodiment the carrier element 35 is a flat strip-like structural part on one of whose broad sides the positioning devices 31, 32, 33 are arranged and can thus be removed from the existing free side.

The positioning devices 31, 32 are formed in each case by three star-shaped projections, in the present case in the form of pins 37, arranged distributed around a central axis running transverse to the strip-like carrier element 35, the center-to-center distance of the said pins being chosen so that the relevant reel 5 is centered therebetween. In a similar manner the positioning device 32 is formed by three or more pins 38 that surround and center the take-up reel 6. In the position existing in the centering devices 31, 32 the reels 5,6 may abut the carrier element 35, or spacing members may also be provided separating the reels from the carrier element, these members in the case of the present embodiment being formed by shoulders 39 arranged in the base of the pins, and against which rest the relevant reel walls 26, 27.

The pins 37, 38 may exert a slight radially inwardly directed clamping action on the reels 5,6 so that these are slightly held between the pins, or they can also be arranged having a small degree of play so that the reels 5,6 can slip out on account of their intrinsic weight.

In order to load the housing 2 with a reel/backing strip arrangement the loading aid 30 has to be moved relative to the opened housing 2 or, in this case, the cover 2*b*, into a transfer starting position in which it is aligned relative to the housing or cover 2*b* so that the arrangement of the reel/backing strip arrangement on the loading aid 30 corresponds to the arrangement in the housing 2. In this connection the loading aid can be held manually or can also rest against the other housing part, for example on the bearing shafts 19, 20. The alignment may be made manually with a visual check. In the aligned position the reels 5, 6 together with the backing strips 7 can be moved into the housing 2 or cover 2*b*, which can take place through their intrinsic weight if the loading aid is inserted, or can be effected by manual displacement. It is advantageous in this connection to place the loading aid first of all with its edge uppermost on the housing 2 and then tilt both parts. After the transfer procedure the loading aid 30 can be removed and disposed of, or collected and reused.

Figure 4:
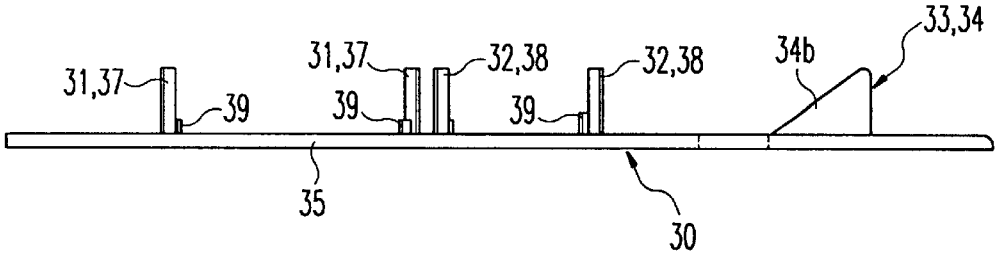
FIG. 4 is a side view of the loading aid.
Figure 3:
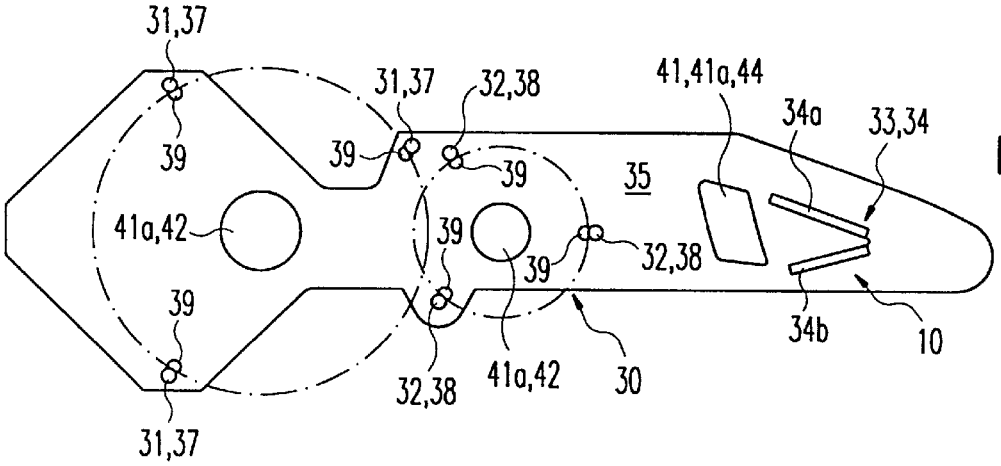
FIG. 3 is a plan view of the loading aid according to the invention.
Figure 6:
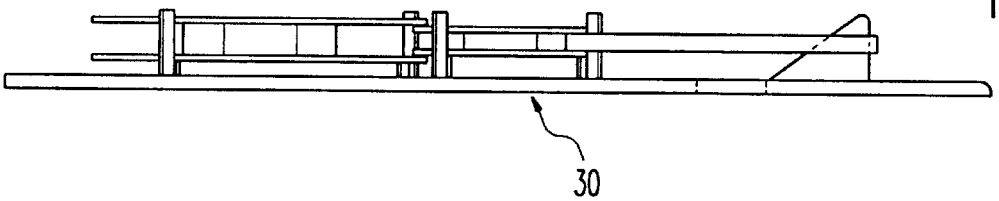
FIG. 6 is a side view of the loading aid according to FIG. 5.
Figure 5:
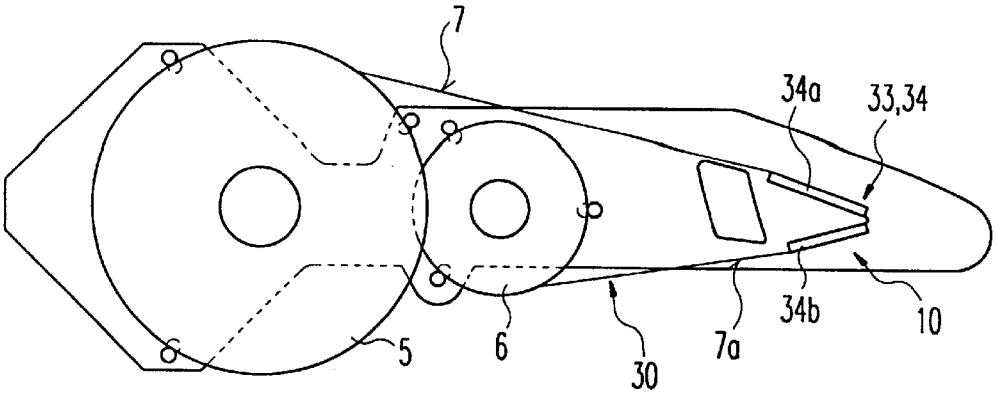
FIG. 5 is a plan view of the loading aid loaded with a supply reel and take-up reel as well as a backing strip.
Figure 7:
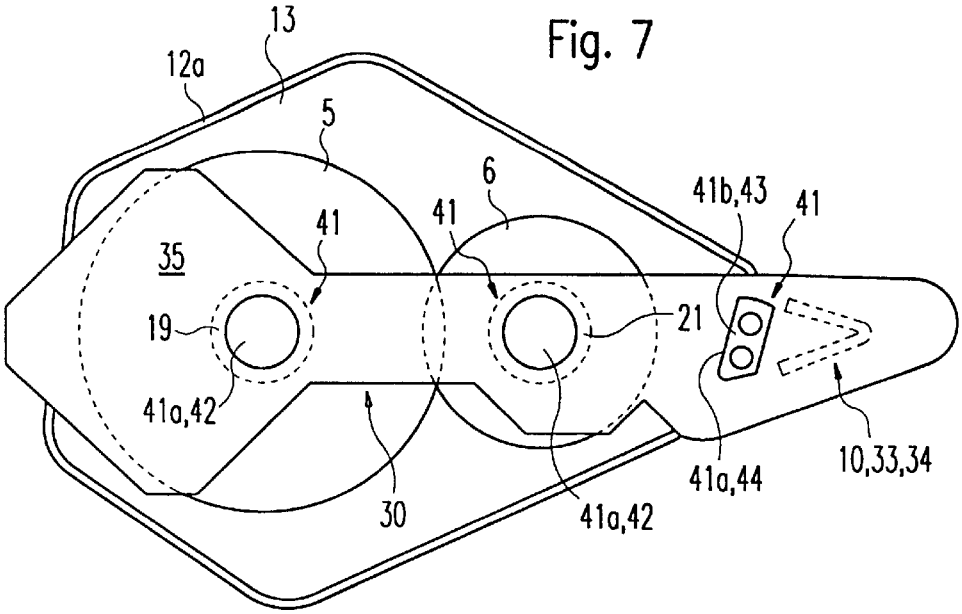
FIG. 7 shows the loading aid and the housing part in the transfer position.

In the present embodiment the positioning and guide element 34 is formed by a wedge or hollow wedge 10, whose cross-sectional shape and wedge walls 34*a*, 34*b* roughly correspond to the cross-sectional shape of the pressure-exerting part 16 and whose height is such that they support the backing strip loop and are able to maintain the shape of the loop. The wedge wall 34*b* associated with the backing strip section running onto the take-up reel 6 is preferably formed so as to converge towards the take-up reel 6 (FIG. 4).

The loading aid 30 is a structural part of low weight and comprising little material, which can be manufactured inexpensively and represents little material loss when it is disposed of, i.e., it is economical to manufacture and use. The structural part is preferably a plastics injection molded part that can be produced in one piece.

It is advantageous to provide on the housing or cover 2*b* and the loading aid 30 a further positioning device 41 with a positioning device part 41*b* associated with the housing part and with a positioning device part 41*a* associated with the loading aid 30, which together permit the correct position to be compared visually or in a positive-locking engagement manner or necessarily produce the correct position mechanically.

In the present embodiment two holes 42 are provided in the strip-like carrier element 35, the size and diameter of the holes being adapted roughly to the size of the bearing axes 19, and preferably being somewhat larger. In this way the loading aid 30 can, after optically checking, be aligned in a simple and quick manner in the transfer starting position. Another embodiment of the positioning device 41 is similarly accomplished according to FIGS. 3 to 6. In this embodiment the positioning device part 41*a* is formed by two spaced apart projections that cooperate in positively locking manner with two counter-elements arranged on the cover 2*b*, or alternatively is formed by a non-circular projection 43 that is arranged on one side of the application part 16 and may serve both for the positive-locking engagement positioning of the application part 16 on an associated side wall 13 and for the positioning of the loading aid 30, by engagement in a recess 44 of appropriate shape and size in the carrier element 35.

It is advantageous to arrange the positioning device part 41*a* in the vicinity of the holding and guide element 34. In this way it is possible first of all to bring the positioning device 41 into operation by a somewhat inclined arrangement of the loading aid 30 and then bring together the loading aid 30 and the cover 2*b*. It is particularly advantageous to make the loading aid 30 of a flexible material so that it can be mounted in a slightly bent state in the region of the positioning device 41 and the remaining part of the loading aid can then be bent back in order to bring it into the transfer position.

For the rest, the carrier element 35 has lateral or also further recesses in order to reduce weight and save material.

Figure 9:
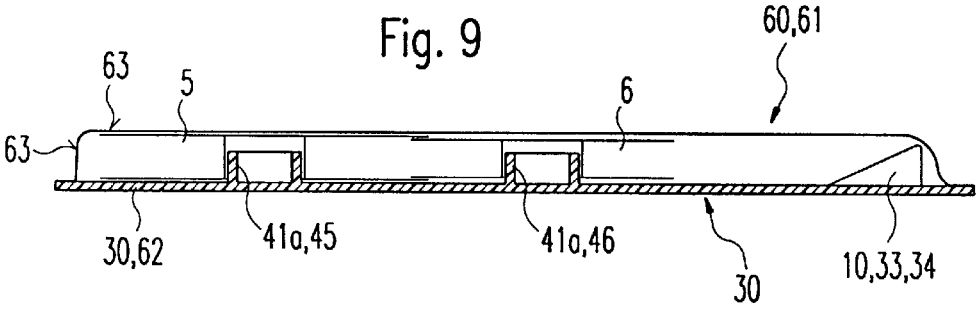
FIG. 9 is a side view of the loading aid according to FIG. 8.
Figure 8:
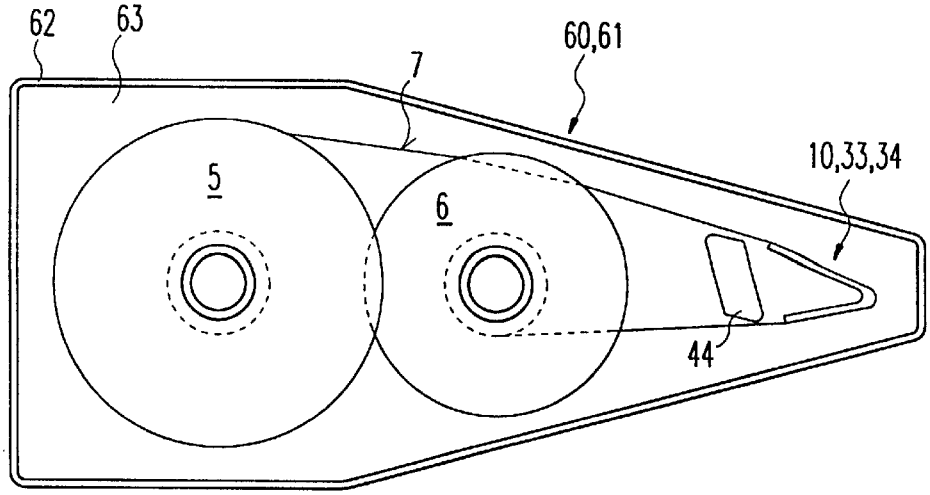
FIG. 8 is a plan view of loading aid in a modified embodiment as a packaging means.

In the embodiment of the loading aid 30 according to FIGS. 8 and 9, in which identical or comparable parts are provided with the same reference numerals, two positioning device parts 41*a* are formed by preferably hollow pegs 45, 46 that project preferably in one piece from the carrier element 35 and that are adapted to the holes provided in the reels 5, 6 so that they can engage therein with a slight play or can exert a slight clamping action.

The loading aid 30 may in combination with a further packaging part, for example a cover, comprise part of a packaging 60 for the reels/backing strip unit. The packaging may be a blister pack 61 whose blister floor 62 or cover foil 63 are designed as a loading aid. After removing the cover foil 63 the blister floor 62 can be used as a loading aid.

Within the scope of the invention it is also possible to arrange the positioning device parts 41*a*, 41*b* in the edge region of the housing part and of the carrier element 35, so that the positioning is effected by a positive-locking engagement cooperation and centering in the edge region.

In the embodiment according to FIGS. 10 and 11, in which identical or comparable parts are similarly provided with the same reference numerals, the preferably likewise hollow bearing pegs 45, 46 are made sufficiently long that they project beyond the reels 5,6. The free ends of the bearing pegs 45, 46 are convergently stepped, and shaped conically or rounded. An independently centering positioning device 41 is thereby formed since the projecting ends of the bearing pegs 45, 46 can on account of the convergence easily be introduced into the hollow bearing shafts 19 and thereby effect an independent centering and positioning. The bearing pegs 45, 46 may be open or closed in the region of their free ends. The guiding and positioning part 34 may be formed as one piece or may be detachably connected to the carrier element 35 by means of a positive-locking engaging plug-in device 34*c* and may optionally be formed and appropriately held by means of a pressure-exerting part. The plug-in device 34*c* may be formed by holes 34*d* and pins 34*e* insertable therein. A strip guide element 34*f*, for example in the form of a pin for the wind-on edge of the strip 7, may be arranged between the positioning part 34 and the take-up reel 6.

FIG. 12 likewise shows a releasable locking device 51 for independently locking the housing parts to one another. The central parts of the locking device 51 are an elastically bendable locking arm 52 on whose free end a catch 53 is formed. The locking arm 52 is situated in the vicinity of the housing part that carries it, in this case the underpart 2*a*, in which connection it may preferably be formed in one part on the circumferential wall 12 or on the side wall 11 or cut or punched out from the latter, the length of the arm being such that it engages behind a locking edge 54 on the cover 2*b* or on a small circumferential edge 2*c* of the cover 2*b*. The catch 53 has a run-on incline 55 which on closure of the cover 2*b* impacts against an edge of the other housing part and produces an elastic outward bending of the locking arm 52, following which after the further closing of the housing parts the catch 53 independently snaps into place behind the locking edge 54. In this case the free end of the locking arm 52 or the catch 53 can engage in a recess 56 arranged in another housing part. The width of this recess is sufficiently large so that the locking arm 52 can be bent in its position releasing the locking edge 54. It is also advantageous to design the arrangement so that the top surface of the catch 53*e* which in the present case is formed by its run-on incline 55 corresponding to the external contour of the associated housing part, forms a uniform external contour in the closed state of the housing 2.

In order to release this locking device 51 an actuating lug 57 may advantageously be arranged on the side of the locking arm 52 pointing in the locking direction. The actuating lug 57 fits in a recess 58 in the circumferential wall 12 of one or other of the housing parts, and preferably likewise forms part of the external contour. The actuating lug 57 is thus accessible from the outside. By depressing the actuating lug 57 the locking arm 52 can be moved to its release position, from which it then independently springs into its locking position on account of its inherent elasticity.

I claim:

1. A hand-held implement for transferring a film (25) of an adhesive, coating or colored material from a supporting strip (7) wound on a supply reel (5) onto a substrate, the said implement having a housing (2), a pressure-exerting part (16) projecting therefrom and two bearing and/or carrier devices arranged in the interior of the housing for the supply reel (5) and a take-up reel (6) for the supporting strip (7) unwound from the supply reel (5) and guided round the pressure-exerting part (16), the housing being able to be opened for the purposes of replacing the supply reel (5) and the take-up reel (6), wherein a loading aid (30) provided for loading the opened housing (2) with a take-up reel (6) and a supply reel (5) and for housing both reels (5, 6) in a mutual arrangement that is essentially the same as that of the bearing and/or carrier devices, the said loading aid (30) having at least one guide element (34) associated with the guide surface (16*b*, 18) of the pressure-exerting part (16), the guide element being designed to ensure that the supporting strip (7) extending from the supply reel (5) to the take-up reel (6) rests against the latter in such a way that when the loading aid (30) is in the transfer position on the bearings (19, 21) and/or carrier devices, the said supporting strip at least partially overlaps or envelops the pressure-exerting part (3) or can be displaced onto the latter.

2. A hand-held implement as claimed in claim 1, wherein a loading aid (30) in its transfer position is mounted on the bearing and carrier devices.

3. A hand-held implement as claimed in claim 1, wherein a loading aid (30) is designed as a flat plate part from which projecting elements (37, 38) stand proud for positioning both reels (5, 6) and the supporting strip (7*a*) in a mutual arrangement.

4. A hand-held implement according to claim 3, wherein the projecting elements (37, 38) are designed for the positioning and releasable retention of both reels (5, 6) in the mutual arrangement.

5. A hand-held implement as claimed in claim 4, wherein the releasable retention is a clamping retention.

6. A hand-held implement as claimed in claim 3, wherein the projecting elements (37, 38) are designed as elements for engaging in through holes in the reels (5,6).

7. A hand-held implement as claimed in claim 6 wherein the through holes are designed as a central through hole in each of the reels (5,6).

8. A hand-held implement as claimed in claim 7, wherein the length of the pin-elements (37, 38) is less than axial length of the central through holes.

9. A hand-held implement as claimed in claim 7, wherein the central through holes are designed as bearing holes for the bearing devices each in the form of a bearing peg.

10. A hand-held implement as claimed in claim 9, wherein spacing elements (39) project from the side of the loading aid (30) having the pin spacing elements (37, 38), the said elements being associated with the reels (5,6) and being shorter than the pin elements (37, 38).

11. A hand-held implement as claimed in claim 10, wherein the length of the pin elements (37, 38) and the difference in length between the pin elements and the spacing elements (39) is greater than the axial width of the reels (5,6).

12. A hand-held implement as claimed in claim 10, wherein the pin elements (37, 38) and the spacing elements (39) are formed as one piece.

13. A hand-held implement as claimed in claim 1, wherein the loading aid (30) can bend transverse to its plane.

14. A hand-held implement as claimed in claim 1, wherein the loading aid (30) is formed as part of a packaging (60) for the reels (5, 6).

15. A hand-held implement as claimed in claim 14, wherein the packaging (60) is designed as a blister pack (61) and its blister floor (62) or its cover foil (63) are designed as the loading aid (30).

16. A hand-held implement as claimed in claim 1, wherein thee supply reel (5) is designed having two reel walls for axially retaining the supporting strip winding.

17. A hand-held implement as claimed in claim 1, wherein the projecting elements are arranged as pin elements (37, 38) in two groups each on a circumference whose diameter is substantially the same as that of the take-up reel (5) or supply reel (6).

18. A hand-held implement as claimed in claim 17, wherein the pin elements (37, 38) are arranged on the respective circumference with their inner surfaces facing the respective center of the circle, the diameters of the circumferences being somewhat smaller than the diameter of the respective reels (5,6) in order to achieve a clamping retention.

19. A hand-held implement as claimed in claim 1, wherein the loading aid (30) has two inspection openings (42, 43) that permit an inspection of the bearing and carrier devices.

20. A hand-held implement as claimed in claim 1, wherein the pressure-exerting part (16) is triangular with two converging boundary surfaces meeting in a tip (16*a*) or edge constituting the guide surface of the pressure-exerting part and the guide element (34) is preferably defined by the edge of the two similarly converging ridges forming a space that is of substantially the same shape as the space defined by the boundary surfaces of the pressure-exerting part (16), but of smaller dimensions.

21. A hand-held implement as claimed in claim 1, wherein the is housing (2) is designed in two parts, with a housing lower part (2*a*) on which the bearings and/or carrier devices are arranged, and a housing upper part (2*b*) secured by means of a fastening device to the housing lower part (2*a*).

22. A hand-held implement as claimed in claim 21, wherein the fastening device comprises at least one catch arrangement (51).

23. A hand-held implement as claimed in claim 21, wherein the fastening device comprises a hinge arrangement (15).

24. A hand-held implement as claimed in claim 1, wherein a positioning device (41) with cooperating positioning device parts (41*a*, 41*b*) is arranged between the loading aid (30) and the housing part (2*b*) accommodating the reels (5,6).

25. A hand-held implement as claimed in claim 24, wherein the positioning device part (41*a*) of the loading aid (30) is formed by at least one, preferably two pegs (45, 46), which in each case engage in the respective reel hole.

26. A hand-held implement as claimed in claim 25, wherein the peg or pegs (45, 46) is/are longer than the width of the reels (5,6) and the projecting ends of the pegs (45, 46) are convergently shaped in the form of steps or wedges or are rounded, and in each case together with an associated hole, especially in a bearing sleeve supporting the reel (5,6), form the positioning device (41).

27. A hand-held implement as claimed in claim 24, wherein the positioning device part of the loading aid (30) is formed by one or both reel holes and the positioning device part of the housing part (2*b*) is formed by one or two pegs on the housing part (2*b*) engaging in the reel hole or holes.

* * * * *